US005719019A

United States Patent [19]

Janusonis et al.

[11] Patent Number: 5,719,019

[45] Date of Patent: Feb. 17, 1998

[54] ROOM-LIGHT HANDLEABLE DIRECT REVERSAL SILVER HALIDE EMULSIONS CONTAINING NITRO-SUBSTITUTED IMIDAZOLE REREVERSAL SUPPRESSANTS

[75] Inventors: Gaile Antoinette Janusonis; Roger Lok, both of Rochester, N.Y.

[73] Assignee: Eastman Kodak Company, Rochester, N.Y.

[21] Appl. No.: 688,914

[22] Filed: Jul. 31, 1996

[51] Int. Cl.[6] ..... G03C 1/36

[52] U.S. Cl. ..... 430/596; 430/510; 430/523; 430/600; 430/604; 430/605; 430/606; 430/613

[58] Field of Search ..... 430/517, 510, 430/604, 596, 600, 613, 950, 523, 605, 606, 614, 589

[56] References Cited

U.S. PATENT DOCUMENTS

| | | | |
|---|---|---|---|
| 3,615,607 | 10/1971 | Soma et al. | 96/101 |
| 4,495,274 | 1/1985 | Yoshida | 430/523 |
| 4,717,648 | 1/1988 | Ueda et al. | 430/379 |
| 4,923,790 | 5/1990 | Kato et al. | 430/523 |
| 4,990,438 | 2/1991 | Ogi et al. | 430/567 |
| 5,221,601 | 6/1993 | Graindourze et al. | 430/597 |
| 5,240,828 | 8/1993 | Janusonis et al. | 430/605 |

FOREIGN PATENT DOCUMENTS

| | | |
|---|---|---|
| 39 24 571 A1 | 7/1988 | Germany . |

*Primary Examiner*—Thorl Chea
*Attorney, Agent, or Firm*—J. Lanny Tucker

[57] ABSTRACT

Room-light handleable direct silver halide emulsions exhibit a broadened Dmin window when certain nitro-substituted aryl- or heteroaryl-containing imidazoles are included. These imidazoles act as excellent rereversal and Dmin suppressants. Photographic elements are prepared from these emulsions that can be handled in room-light if desired.

20 Claims, No Drawings

ROOM-LIGHT HANDLEABLE DIRECT REVERSAL SILVER HALIDE EMULSIONS CONTAINING NITRO-SUBSTITUTED IMIDAZOLE REREVERSAL SUPPRESSANTS

FIELD OF THE INVENTION

This invention relates to room-light handleable direct-reversal emulsions, and photographic elements containing them. Such emulsions are particularly useful in duplicating films for the graphic arts.

BACKGROUND OF THE INVENTION

Photographic elements that produce images having an optical density directly proportional to the amount of radiation received on exposure are said to be negative working. A positive photographic image can be formed by producing a negative photographic image and then forming a second photographic image which is a negative of the first negative, that is, a positive image. A direct positive image is understood to be a positive image that is formed without first forming a negative image.

A common approach to forming direct positive images is to use photobleach emulsions, that is emulsions having silver halide grains that are internally doped with electron trapping compounds, and fogging the grain surfaces either prior to exposure or during processing. When developed in a surface developer, that is one that will leave the latent image sites within the silver halide grains substantially unrevealed, grains which receive the actinic radiation exposure develop at a slower rate than those not imagewise exposed. The result is a direct positive image.

One use of direct positive emulsions is in high contrast duplicating materials intended for the graphic arts. Some of these materials have low photographic speed and are intended to be used under bright safelight or even ordinary room-light conditions. Such materials are known as "room-light handleable" emulsions, elements or materials. The term "room-light handleable" is intended to denote that the material can be exposed to a light level of 200 lux for several minutes without a significant loss in maximum density. Typically, such materials require on the order of 10,000 ergs/cm$^2$ for Dmin exposure.

One problem associated with direct positive emulsions is a phenomenon called "re-reversal" which limits the exposure latitude of the direct positive emulsions. It will be appreciated that in those areas of a direct positive element which receive no exposure, maximum image density will be developed, while those areas in which minimum density is developed, a greater amount of exposure is received. It has been observed that as the amount of exposure is increased beyond that required to yield minimum density, eventually an increase in density on development starts to occur and the emulsion then acts like a negative-working emulsion. The amount of exposure between that just required to provide minimum density and that beyond which an increase in minimum density starts to form is referred to as the "minimum density window" or "Dmin window".

A broad Dmin window is particularly desirable in graphic arts room-light handleable duplicating films because significant overexposure can occur during image manipulation stages. If the window is not sufficiently large, undesirable density increases result.

A common way of forming a direct-positive emulsion is to internally dope the silver halide grains with a Group VII and VIII metals, such as iridium, rhodium, ruthenium, osmium and rhenium [see U.S. Pat. No. 4,835,093 (Janusonis et al)]. The art has recognized a number of useful sources of iridium ion for such purposes, for example, U.S. Pat. No. 5,240,828 (Janusonis et al) which describes the use of iridium coordination complexes with two or more bromo ligands as particularly advantageous for use in high silver bromide emulsions.

It is extremely difficult to maintain a good Dmin window in room-light handleable reversal elements because high energy exposures are used for such elements. Moreover, many emulsion additives, such as traditional stabilizers and antifoggants, increase Dmin and rereversal and decrease the Dmin window.

It is known that 5-nitrobenzimidazole decreases Dmin and increases the Dmin window as mentioned in U.S. Pat. No. 5,240,828 (noted above). However, this compound can inhibit nucleating development and thus decrease development compatibility of room-light handleable duplicating films and nucleating films.

Rereversal remains a challenge for room-light handleable direct reversal emulsions, and a need still exists to increase the Dmin window especially with emulsions containing stabilizers. In addition, it would be desirable to decrease Dmin further in such emulsions and to maintain high contrast, high Dmax and good image quality.

SUMMARY OF THE INVENTION

The problems noted above are minimized with a room-light handleable, direct-positive silver halide emulsion that requires at least about 10,000 ergs/cm$^2$ to provide minimum density, the emulsion comprising, as a rereversal suppressant, a nitro-substituted aryl- or heteroaryl-containing imidazole that is present in an amount of at least about 0.01 mmol/mol of silver, the nitro-substituted aryl- or heteroaryl-containing imidazole having the structure:

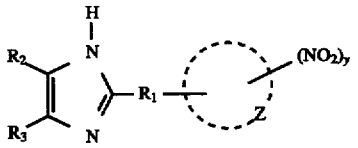

wherein $R_1$ is a single carbon-carbon bond or —CH=CH—, $R_2$ and $R_3$ are independently hydrogen, aryl, nitro-substituted aryl, nitro or cyano, or $R_2$ and $R_3$ together represent the carbon atoms necessary to complete a 6- to 10-membered aromatic carbocyclic ring fused with the imidazole ring, the aromatic carbocyclic ring being unsubstituted or substituted with one or two nitro groups, Z represents the carbon or hetero atoms necessary to complete a 5- to 10-membered aromatic carbocyclic or heterocyclic ring, and y is 0, 1 or 2, provided that when y is 0, then $R_1$ is free of nitro groups and $R_2$ or $R_3$, or $R_2$ and $R_3$ together contain 1 or 2 nitro groups, and when y is 1 or 2, then $R_2$ or $R_3$, or $R_2$ and $R_3$ together, are free of nitro groups, and further provided that the structure is free of alkyl and alkoxy groups.

This invention also provides a photographic element comprising a support having thereon at least one photosensitive layer comprising the silver halide emulsion described above.

In a preferred embodiment, the element of this invention comprises a transparent film support, and has thereon a single photosensitive layer comprising a room-light handleable, direct-positive silver halide emulsion that requires at least about 10,000 ergs/cm$^2$ to provide minimum density, the emulsion comprising from 50 to 100 mol % (based on total silver) silver bromide and no silver iodide, a polyhaloiridium dopant, and as a rereversal suppressant, a nitro-substituted aryl- or heteroaryl-containing imidazole that is present in an amount of from about 0.1 to about 10 mmol/mol of silver, the nitro-substituted aryl- or heteroaryl-containing imidazole having the structure defined above.

The reversal emulsions of this invention can be readily handled in room or safe light, and exhibit good image quality and a large Dmin window that is desired for graphic arts films. Thus, rereversal is desirably suppressed in spite of the presence of various additives in the emulsion that tend to decrease the Dmin window.

These advantages are achieved by including in the emulsions, a nitro-substituted aryl- or heteroaryl-containing imidazole as a rereversal suppressant. These compounds provide development compatibility with nucleating films, and do not interfere with nucleating development nor degrade image quality. Increased or undiminished safelight safety time is also provided. The imidazoles do not decrease contrast or Dmax, and enhance image quality.

DETAILED DESCRIPTION OF THE INVENTION

The emulsions of this invention comprise grains of one or more silver halides dispersed in suitable binders. Such materials are readily known in the art, including the description in *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as *"Research Disclosure"*. More details about such elements are provided herein below.

Various silver halide grains can be used in the emulsion, singly or in mixtures, including silver chloride, silver bromide, silver bromochloride, silver chlorobromide, silver iodobromide, silver iodochloride and silver iodobromochloride. Preferably, the emulsions comprise at least 50 mol % silver bromide and up to 50 mol % silver chloride, based on total silver. More preferably, the emulsions comprise at least 90 mol %, and most preferably, 100 mol % silver bromide, based on total silver, and no silver iodide. High silver chloride emulsions can also be used, such emulsions containing at least 90 mol % silver chloride and no silver iodide.

The silver halide grains can have any desired morphology, including tabular or 3-dimensional. The grains are preferably monodispersed having a mean grain size of less than 0.7 μm, and optimally less than 0.3 μm. The emulsions can be doped with conventional dopants (as described in detail below) using conventional procedures and amounts, or can contain conventional electron-trapping photobleach dyes. They can be surface-fogged using conventional reducing agents (including thiourea dioxide, tin compounds, amine boranes and borohydrides).

Such emulsions are generally prepared by precipitating silver halide grains by bringing together in a reaction vessel containing an aqueous dispersing medium (such as a dilute solution of gelatin), a source of silver ions (such as silver nitrate), a source of the desired halide ions (such as ammonium or alkali metal halide salts), and various other addenda including the imidazole compounds, dopants and other components described below.

The imidazole compounds useful as antifoggants or rereversal suppressants have one or two nitro substituents, preferably on an aryl or heteroaryl group. These compounds can be generally defined by the structure:

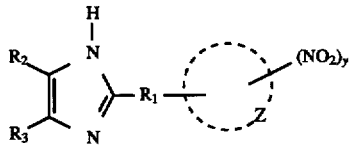

wherein $R_1$ is a single carbon-carbon bond or substituted or unsubstituted —CH=CH—. Preferably, $R_1$ is unsubstituted —CH=CH— but it can also be substituted with cyano, nitro or trifluoromethyl groups.

Moreover, $R_2$ and $R_3$ are independently hydrogen, substituted or unsubstituted aryl having 6 to 10 carbon atoms (such as phenyl or naphthyl and others readily apparent to one skilled in the art), and particularly a nitro-substituted aryl (having one or two nitro groups). Each of these groups can also be nitro or cyano.

Alternatively and preferably, $R_2$ and $R_3$ together represent the carbon atoms necessary to complete a 6- to 10-membered aromatic carbocyclic ring fused with the imidazole ring. Such an aromatic carbocyclic ring can be substituted with one or two nitro groups, or with other substituents readily apparent to one skilled in the art. More preferably, a benzimidazole ring is formed with $R_2$ and $R_3$ together fused with the imidazole ring, which ring is substituted with one or two nitro groups. Most preferably, there is only one nitro group on the substituted ring.

Also in the structure noted above, Z represents the carbon or hetero atoms necessary to complete a substituted or unsubstituted 5- to 10-membered aromatic carbocyclic or heterocyclic ring. Such carbocyclic rings include, but are not limited to, phenyl or naphthyl, which can also be substituted with one or two nitro groups as well as other groups such as cyano and trifluoromethyl. The aromatic heterocyclic rings include, but are not limited to, furanyl, pyridinyl, benzofuranyl, thiofuranyl, isoxazolyl, benzoxazolyl, thiazolyl and pyrimidinyl, which can also be substituted with one or two nitro groups. Preferably, Z forms a nitro-substituted or unsubstituted phenyl or furanyl group, and more preferably, it forms a phenyl group with one nitro substituent.

As noted above, the imidazole compound must have at least one nitro group, and it is most preferred that the one or two nitro groups be on the same side of the imidazole ring of the molecule. Thus, the nitro group(s) are either on $R_2$ or $R_3$ (or the two groups taken together), or on the ring formed by Z. Preferably, the nitro groups are on $R_2$ and $R_3$ taken together.

Thus, while y can be 0, 1 or 2, when y is 0, then $R_1$ is free of nitro groups and $R_2$ or $R_3$ (or $R_2$ and $R_3$ together), contain 1 or 2 nitro groups, and when y is 1 or 2, then $R_2$ and $R_3$ are free of nitro groups.

In addition, the imidazole compounds are free of alkyl or alkoxy groups which are electron-donating groups.

The following compounds are representative of the nitro-substituted imidazole compounds useful in this invention. Compounds 6, 7, 9, 10, 13, 20, 22, 38, 42, 44, 46, 47 and 48 are preferred, and Compounds 6, 13 and 44 are more preferred. Compound is most-preferred.
Compound 1
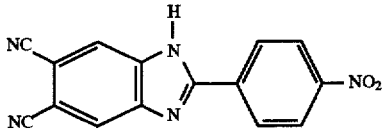
Compound 2
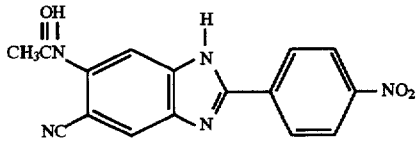
Compound 3
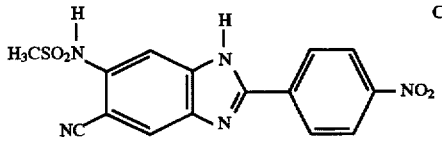
Compound 4
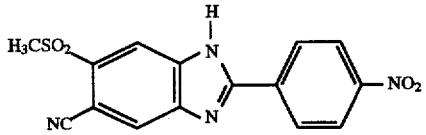
Compound 5
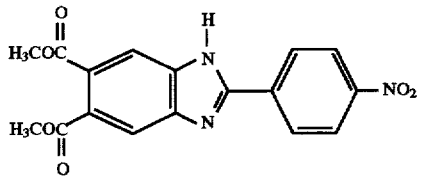
Compound 6
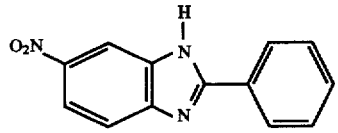
Compound 7
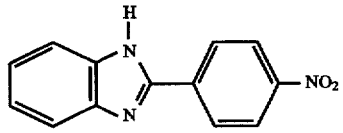
Compound 8
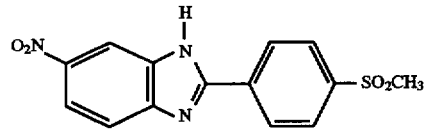
Compound 9
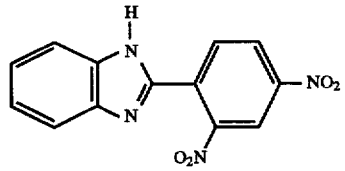
Compound 10
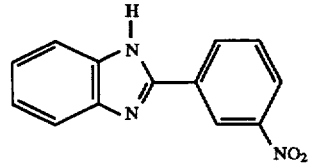
-continued
Compound 11
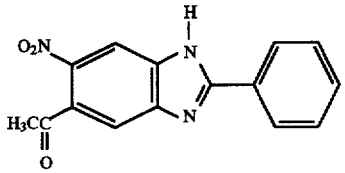
Compound 12
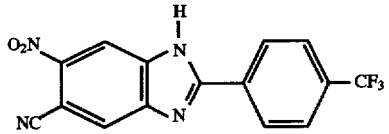
Compound 13
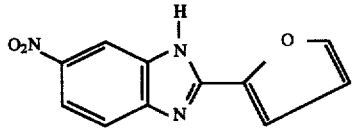
Compound 14
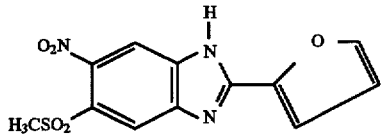
Compound 15
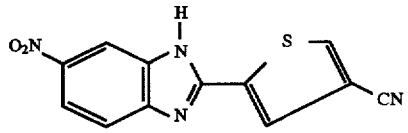
Compound 16
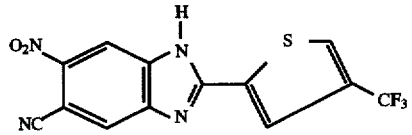
Compound 17
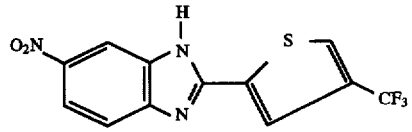
Compound 18
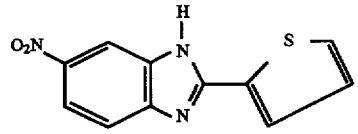
Compound 19
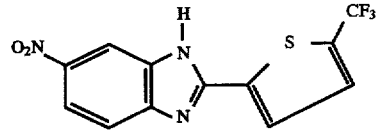
Compound 20
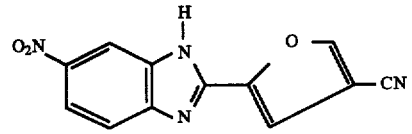
Compound 21
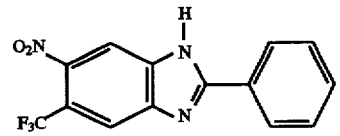

-continued
Compound 22
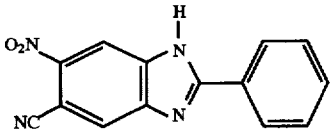
Compound 23
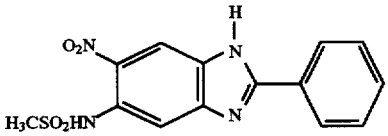
Compound 24
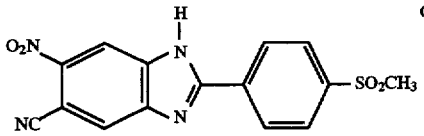
Compound 25
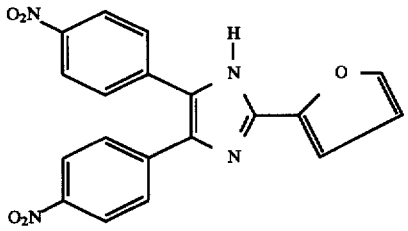
Compound 26
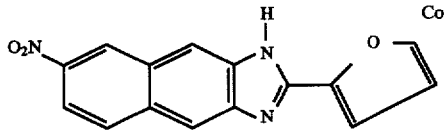
Compound 27
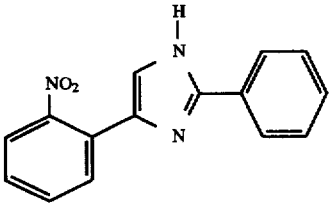
Compound 28
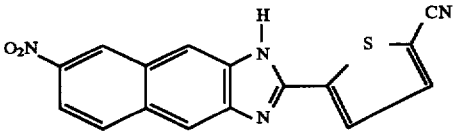
Compound 29
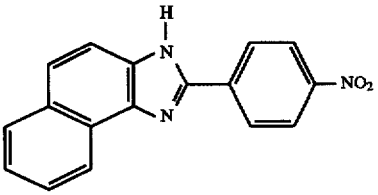
Compound 30
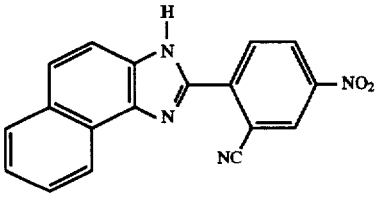
-continued
Compound 31
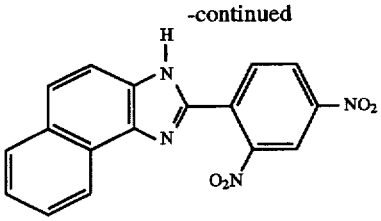
Compound 32
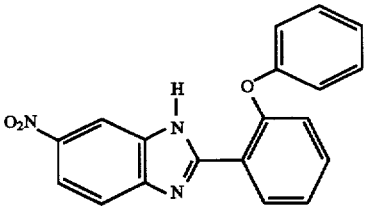
Compound 33
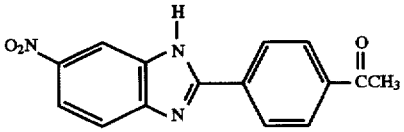
Compound 34
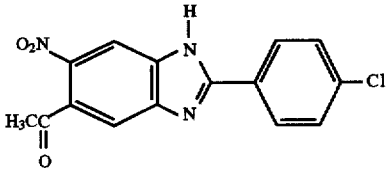
Compound 35
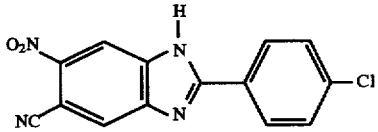
Compound 36
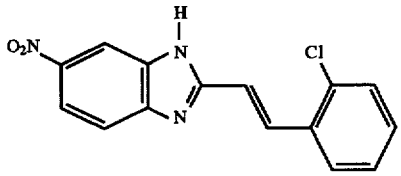
Compound 37
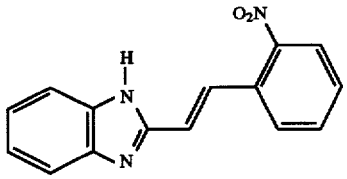
Compound 38
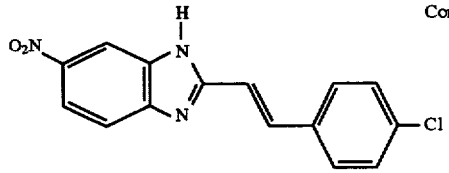
Compound 39
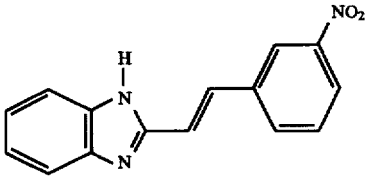

-continued

Compound 40

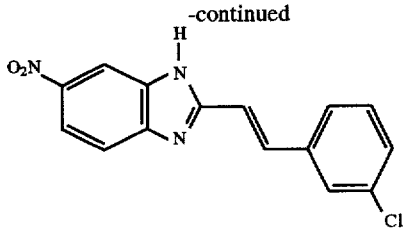

Compound 41

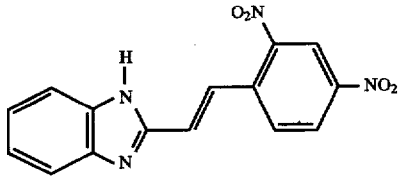

Compound 42

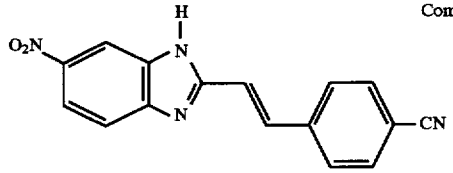

Compound 43

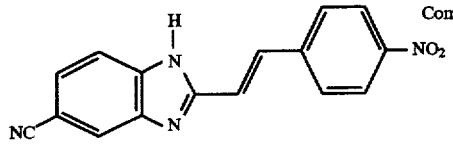

Compound 44

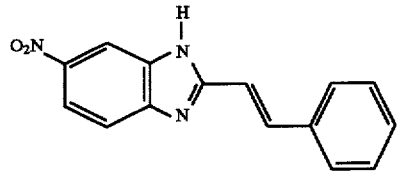

Compound 45

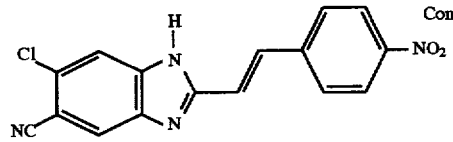

Compound 46

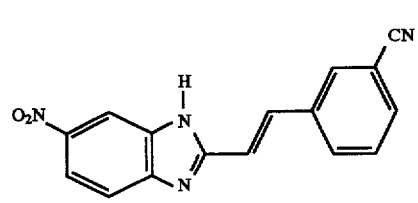

Compound 47

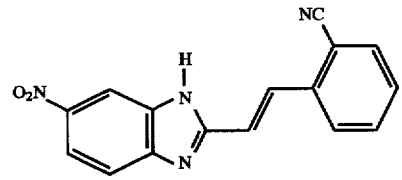

Compound 48

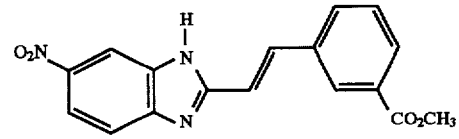

-continued

Compound 49

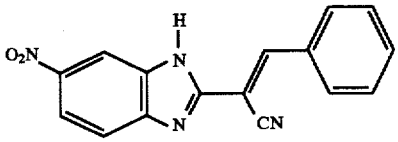

More than one of the nitro-substituted aryl or heteroaryl-containing imidazole compounds described above can be used in the emulsion of this invention. The one or more compounds are present in an amount of from about 0.01 to about 50 mmol/mol of silver in the emulsion, preferably at from about 0.1 to about 10 mmol/mol of silver, and more preferably at from about 0.5 to about 4 mmol/mol of silver.

Useful dopants that can be in the emulsions of this invention include complexes of metals such as iridium, rhodium, ruthenium, osmium and rhenium to enable complete photobleaching of the surface fog by the photoholes, and hence, good reversal image formation.

Particularly useful dopants for high silver bromide emulsions include polyhaloiridium compounds, as described for example, in U.S. Pat. No. 5,240,828 (noted above), the disclosures of which are incorporated by reference. The dopant can be added to the emulsion at a suitable time as described in the noted patent. The amount of dopant typically used is in the range of $1\times10^{-6}$ to about $1\times10^{-4}$ mol iridium per mol of silver.

The polyhaloiridium compounds typically have two or more halo ligands with the remaining ligands being selected from aquo and nitrosyl. For high silver bromide emulsions, preferably the polyhalo ligands are bromo ligands, and remaining ligands can also be aquo, chloro, fluoro, iodo or nitrosyl ligands. For the preferred silver bromide emulsions, useful complexes have four or more bromo ligands, and especially preferred are hexabromo complexes. For high silver chloride emulsions, polychloro-aquo complexes are especially preferred.

The counterions of the polyhaloiridium compounds are not critical and can include alkali metal ions and ammonium. Potassium ion is a preferred counterion.

Some representative polyhaloiridium dopants are described in Column 4 of U.S. Pat. No. 5,240,828 (noted above) and in U.S. Pat. No. 4,902,611 (Leubner et al). For example, useful dopants include $K_2IrBr_6$, $K_3IrBr_6$, $K_2IrCl_6$, $K_3IrCl_6$, $K_2Ir(H_2O)Cl_5$, $KIr(H_2O)_2Cl_4$, $K_2Ir(H_2O)Br_5$ and $KIr(H_2O)_2Br_4$.

The emulsions of this invention can be sensitized with spectral sensitizers commonly used for spectral sensitization of negative or positive working emulsions (especially the photobleach dyes). Preferably, however, spectral sensitizers are not used.

Stabilization of the emulsions can be accomplished by including one or more mercapto-containing compounds such as mercaptotetrazoles, mercaptobenzoxazoles, mercaptooxazoles, mercaptooxadiazoles, mercaptothiazoles, mercaptobenzothiazoles, mercaptotriazoles, mercaptobenzimidazoles and nitrothiophenols. Stabilizers may be particularly useful in high silver bromide emulsions (that is, emulsions having silver bromide greater than 50 mol %). Especially preferred stabilizers are heterocyclic mercapto-containing compounds also comprising a nitro group because such compounds are less likely to diminish the Dmin window. Some preferred stabilizers include the following compounds or their monovalent metal salts: 1(4-nitrophenyl)-5-mercaptotetrazole, 1-(3-nitrophenyl)-5-mercaptotetrazole, 5-nitro-2-mercaptobenzoxazole, 6-nitro-2-mercaptobenzoxazole, 4-methyl-5-nitro-2-mercaptothiazole, 2,2'-dithiobis(4-methyl-5-nitrothiazole), 5-nitro-2-mercaptobenzothiazole and 6-nitro-2-mercaptobenzothiazole. The amounts of stabilizers are generally from about $5\times10^{-5}$ to about $5\times10^{-3}$ mol per mol of silver.

The emulsions can also contain other components that provide various desired spectral, image quality, sensitometric or physical properties, as is commonly known in the art.

One or more binder materials are included in the emulsions, including but not limited to, gelatin and other hydrophilic colloids, various synthetic materials as are described in the art, including *Research Disclosure,* identified above. Gelatin is the preferred binder material.

The photographic elements of this invention typically have a support material on which the photographic emulsion is disposed. Useful support materials well known in the art include, but are not limited to, glass, ceramics, papers (including resin-coated papers), polymeric films, cellulose nitrate and others readily apparent to a skilled worker. Polymeric films, such as polyester films, are preferred with poly(ethylene terephthalate) and poly(ethylene naphthalate) being most preferred.

In practice, images are formed with the elements of this invention by bringing the element into contact with a half-tone image to be duplicated and then exposing the element to high-intensity (typically 1500 watts) illumination from a metal halide light source for a period of time sufficient to trap the photo-electrons and generate photo-holes to photobleach the surface fog in the exposed areas, thus rendering the silver halide in those areas nondevelopable in a surface developer under conditions generally used to develop a surface sensitive silver halide emulsion. Processing formulations and techniques are described in Mason, *Photographic Processing Chemistry,* Focal Press, London, 1966, *Processing Chemicals and Formulas,* Publication J-1, Eastman Kodak Company, 1973, *Photo-Lab Index,* Morgan and Morgan, Inc., Dobbs Ferry, N.Y., 1977, and *Neblette's Handbook of Photography and Reprography Materials, Processes and Systems,* VanNostrand Reinhold Company, 7th Ed., 1977. The term "surface developer" is defined in U.S. Pat. No. 5,240,828 (noted above).

Typical developing agents that can be used to develop the elements of this invention include hydroquinones, catechols, aminophenols, 3-pyrazolidinones, ascorbic acid and its derivatives, reductones, phenylenediamines, or others readily apparent to one skilled in the art, or combinations thereof. The developing agents can be in an aqueous developing solution or incorporated into the element itself. Once developed, the elements are generally fixed using a known fixing solution containing one or more suitable fixing agents. Once washed, the element is then dried to provide the desired finished image.

Materials and Methods for Examples:

Sensitometric exposures of the photographic elements described in Examples 3–7 and 9 were obtained by placing them in contact with a 0.10 density increment carbon step wedge and exposed to a 1000 W metal halide lamp with sufficient exposure time to produce reversal.

The photographic element described in Example 8 was exposed to a 1000 W quartz (tungsten) halogen lamp in a similar manner as noted above.

Practical exposures were obtained by placing the elements in contact with a target that contained a Dmin and a Dmax patch, and a 50% dot pattern. Using a 1000 W metal halide or 1000 W quartz (tungsten) exposing device, the elements were stepped off by varying the exposure in 0.1 log E increments from slightly under Dot-for-Dot exposure to exposures that were greater than 3.0 log E than the optimum exposure. This exposure series produced a practical D log E curve and a dot growth curve, including the rereversal portion (extreme overexposure) or Dmin window for each element.

Processing of the exposed elements was carried out as follows in a KODAK K65A Rapid Access Processor.

For Examples 3, 4, 6 and 9, the elements were developed for 22 seconds at 35° C. with a developing solution containing one part commercially available KODAK RA 2000 Developer and Replenisher and four parts of water (identified below as "RA"). They were then fixed in a solution of one part of commercially available KODAK 3000 Fixer and Replenisher and three parts of water, except when specified otherwise.

For some measurements, the same elements were developed for 38 seconds at 35° C. in commercially available KODAK ULTRATEC Developer and Replenisher (identified below as "UT"), and fixed in commercially available KODAK ULTRATEX Fixer and Replenisher.

The elements of Example 7 were developed for 30 seconds at 35° C. in a developing solution consisting of one part of commercially available KODAK RA 2000 Developer and Replenisher and two parts of water. The elements were then fixed using commercially available KODAK 3000 Fixer and Replenisher that had been diluted as described above.

Sensitometric and safelight measurements for the elements in Example 5 were obtained by development as described for Example 7, and the practical measurements were obtained as described for Example 3.

The following examples further illustrate the present invention, but are not intended to limit it in any way.

EXAMPLE 1

Preparation of Silver Bromide Emulsions

The reaction vessel contained gelatin (24 g/final Ag mol) and distilled water (450 ml/Ag mol), and was maintained at 50° C. To this solution was added 3,6-dithia-1,8-octane diol (0.09 g/Ag mol) followed by stirring for five minutes. The pAg was adjusted to 8.13 with potassium bromide (3 molar) and the pH was adjusted to 3.0 with nitric acid (3 molar).

A solution of silver nitrate (3.0 molar) was run into the reaction vessel at 133.3 ml/min. simultaneously with a solution of sodium bromide (3.0 molar) at 133.5 ml/min. The pAg was maintained at 8.13 throughout the precipitation.

A dopant solution was prepared by dissolving $K_3IrBr_6$ (15.8 mg) per ml of potassium bromide solution (3 molar). This solution was added to the reaction vessel within the first 3 minutes of precipitation or less, from a third jet to the mixer head, and $1.5\times10^{-5}$ of iridium/Ag mol was incorporated into the emulsion grains.

The resulting silver halide emulsion was cooled to 40° C., and washed by ultrafiltration for about 60 minutes. It was then concentrated to 0.6 kg/Ag mol. The average grain size was 0.17 μm. Additional gelatin was added to a total of 40 g/Ag mol, and the emulsion was fogged with anhydrous potassium tetrachloroaurate and thiourea dioxide at 70° C. and pH 6. The pAg was adjusted to 8.2 at 40° C., prior to the temperature rise. A nitro-containing mercapto stabilizer (described below) was added to the emulsion.

Nitro-substituted imidazole compound 6, 10, 13, 44 or 49 was added at 0.5–10.0 mol/Ag mol to provide emulsions for the elements of Examples 3–7 and 9 below prior to coating.

EXAMPLE 2

Preparation of Silver Chloride Emulsions

A silver chloride emulsion of this invention was prepared using a procedure similar to that described in Example 1 except for the following: sodium chloride was substituted for sodium bromide, no ripener was added to the precipitation, the pAg was adjusted to 7.4 and maintained throughout the precipitation, the dopant was $KIr(H_2O)_2Cl_4$, and prior to the fogging-temperature rise, the pH was adjusted to 5.5 and the pAg was adjusted to 7.2.

EXAMPLE 3

Silver Bromide Element

A photographic element was prepared using the emulsion described in Example 1 that was stabilized with 1-(4-nitrophenyl)-5-mercaptotetrazole (0.5 mmol/Ag mol), and contained the benzimidazoles shown in Table I below.

The emulsions were coated on a poly(ethylene terephthalate) film support, and were overcoated with a formulation to provide gelatin (1.6 g/m$^2$), poly (methyl methacrylate) beads (15 mg/m$^2$) and TRITON 200 surfactant (32 mg/m$^2$). The emulsion layer contained silver at 2.5 g/m$^2$, gelatin at 2.5 g/m$^2$, poly(methyl acrylate-co-2-acrylamido-2-methylpropane sulfonic acid) secondary binder at 700 mg/m$^2$, TRITON™ 200 surfactant at 32 mg/m$^2$ and ethylenediaminetetraacetic acid at 66 mg/m$^2$. Both layers were hardened with a conventional hardener (5.6 weight % of total gelatin), and contained glycerol at 5 weight % of total gelatin.

Most of the emulsions exhibited increased Dmin, reduced speed and decreased toe contrast (lower scale contrast). The emulsions of this invention containing Compound 13, however, exhibited reduced Dmin and increased toe contrast.

TABLE I

| Antifoggant | mmol/Ag mol | Delta Speed[1] at 0.1 D | Delta Dmin[2] "RA" | Delta Dmin[2] "UT" | LSC[3] "RA" | LSC[3] "UT" |
|---|---|---|---|---|---|---|
| 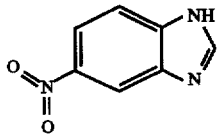 | 4 | −3 | −0.001 | −0.003 | 3.4 | 3.4 |
| | 7 | −4 | −0.003 | −0.005 | 3.3 | 3.6 |
| 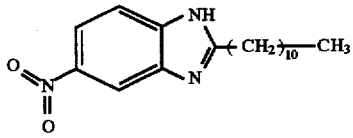 | 4 | −4 | 0 | 0 | 3.4 | 3.5 |
| 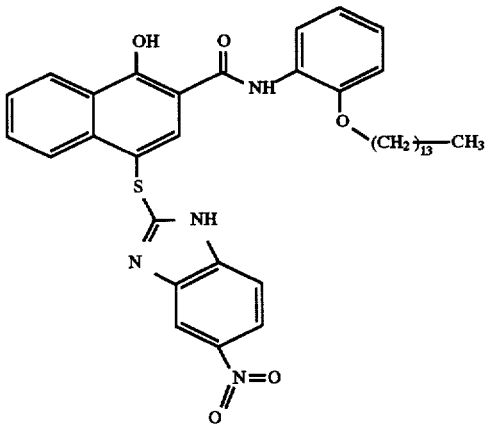 | 4 | −6 | +0.001 | 0 | 3.3 | 3.4 |
| Compound 13 | 4 | −14 | −0.003 | −0.002 | 3.5 | 3.7 |
| 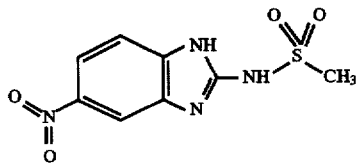 | 4 | −180 | +0.024 | +0.024 | 1.3 | 1.3 |

TABLE I-continued

| Antifoggant | mmol/Ag mol | Delta Speed[1] at 0.1 D | Delta Dmin[2] "RA" | Delta Dmin[2] "UT" | LSC[3] "RA" | LSC[3] "UT" |
|---|---|---|---|---|---|---|
| 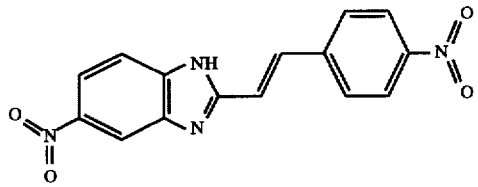 | 4 | −29 | +0.001 | 0 | 2.5 | 2.7 |
| | 7 | −36 | +0.005 | +0.005 | 2.3 | 2.4 |
| 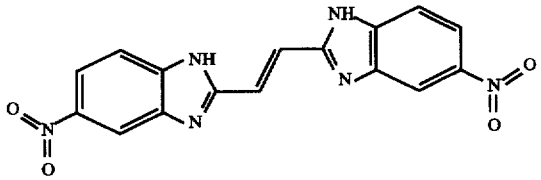 | 4 | −30 | +0.067 | +0.063 | 3.3 | 2.8 |
| | 7 | −38 | +0.097 | +0.083 | 1.8 | 1.7 |

[1](Speed antifoggant - Speed control) measured at net specified density
[2](Dmin antifoggant - Dmin control)
[3]Lower Scale Contrast measured by taking a slope between 0.10 and 0.60 net density

EXAMPLE 4

Comparison of Various Silver Bromide Elements

The emulsion of Example 1 containing various benzimidazole compounds was used to prepare several elements. Each emulsion was stabilized with the stabilizer of Example 3 (0.5 mmol/Ag mol).

Each element was prepared by coating the emulsion on a poly(ethylene terephthalate) film support to provide silver at 2.55 g/m$^2$, gelatin at 1.6 g/m$^2$ and poly(methyl acrylate-co-2-acrylamido-2-methylpropane sulfonic acid) secondary binder at 484 mg/m$^2$. Prior to coating, the emulsions were adjusted to a pH of 5.5 and a pAg of 8.2. The benzimidazoles were added prior to coating out of methanol.

Over the emulsion was coated an interlayer to provide gelatin at 1.2 g/m$^2$, poly(n-butylacrylate-co-N-isopropyl methacrylamide-co-methacrylamide) at 608 mg/m$^2$, a conventional magenta water-soluble filter dye at 107 mg/m$^2$ and a yellow solid particle filter dye at 161 mg/m$^2$.

A final overcoat layer was coated to provide gelatin at 489 mg/m$^2$, poly(methyl methacrylate) beads at 15 mg/m$^2$, a lubricant containing a mixture of alcohol esters of methyl myristate, methyl palmitate and methyl stearate at 21.5 mg/m$^2$, TRITON™ 200 surfactant (19 mg/m$^2$) and LODYNE™ S-100 surfactant at 8 mg/m$^2$.

Each layer formulation was hardened with a conventional hardener (5.5 weight % of total gelatin) and contained glycerol at 4.5 weight % of total gelatin.

The benzimidazoles used in the elements are shown in Tables II and III. Compounds 10 and 13 were found to not only be good antifoggants, but also good rereversal suppressants. Compound 10 showed comparable rereversal suppression at 2 mmol to the comparison compound, 5-nitrobenzimidazole, at 6 mmol per Ag mol. Furthermore, both Compounds 10 and 13 increased the lower scale contrast and enhanced image quality while not adversely affecting speed or Dmax.

TABLE II

| Antifoggant | mmol/Ag mol | Speed[1] at 0.1 D | LSC[2] | Dmin | Delta Rereversal[3] |
|---|---|---|---|---|---|
| None | 0 | (172) | 3.1 | 0.022 | — |
| 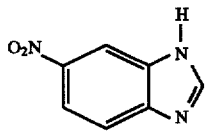 | 1 | 166 | 3.1 | 0.023 | −0.005 |
| | 2 | (181) | 3.8 | 0.021 | −0.01 |
| Compound 13 | 1 | 169 | 3.3 | 0.021 | −0.02 |
| | 2 | 168 | 3.8 | 0.021 | −0.05 |
| Compound 10 | 1 | 167 | 4.0 | 0.021 | −0.045 |
| | 2 | 168 | 3.9 | 0.021 | −0.05 |

TABLE II-continued

| Antifoggant | mmol/Ag mol | Speed[1] at 0.1 D | LSC[2] | Dmin | Delta Rereversal[3] |
|---|---|---|---|---|---|
| 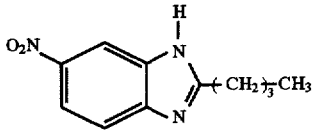 | 1 | 167 | 3.5 | 0.022 | −0.02 |
| | 2 | 168 | 3.2 | 0.023 | −0.01 |
| 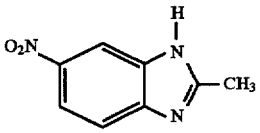 | 1 | 163 | 2.9 | 0.022 | −0.01 |
| | 2 | 127 | 1.4 | 0.028 | −0.01 |

[1]Speed measured at net specified density
[2]Lower scale contrast measured by taking a slope between 0.10 and 0.60 net density
[3](D antifoggant - D control) measured at 2.5 log E higher exposure than dot-for-dot exposure

TABLE III

| Antifoggant | mmol/Ag mol | Speed[1] at 0.1 D | LSC[2] | Dmin | Rereversal[3] | Delta[4] Rereversal |
|---|---|---|---|---|---|---|
| None | 0 | 171 | 3.0 | 0.023 | 0.09 | — |
| 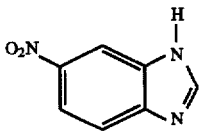 | 2 | 163 | 3.4 | 0.025 | 0.09 | −0.004 |
| | 4 | 172 | 4.1 | 0.023 | 0.07 | −0.02 |
| | 6 | 168 | 3.8 | 0.022 | 0.06 | −0.03 |
| 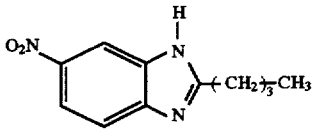 | 2 | 158 | 2.8 | 0.025 | 0.10 | +0.01 |
| | 4 | 153 | 2.5 | 0.024 | 0.10 | 0.0 |
| | 6 | 151 | 2.2 | 0.023 | 0.10 | +0.01 |
| Compound 10 | 2 | 169 | 3.7 | 0.023 | 0.06 | −0.03 |
| | 4 | 166 | 3.5 | 0.023 | 0.06 | −0.03 |
| | 6 | 171 | 3.7 | 0.023 | 0.06 | −0.03 |
| 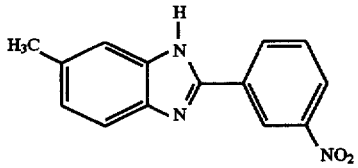 | 2 | 158 | 3.4 | 0.023 | 0.07 | −0.02 |
| | 4 | 168 | 3.6 | 0.022 | 0.08 | −0.01 |
| | 6 | 169 | 2.8 | 0.025 | 0.08 | −0.01 |

[1]Speed measured at net specified density
[2]Lower scale contrast measured by taking a slope between 0.10 and 0.60 net density
[3]Rereversal density measured at 2.5 log E higher exposure than dot-for-dot exposure
[4](D antifoggant - D control) measured at 2.5 log E higher exposure than dot-for-dot exposure

EXAMPLE 5

Comparisons Using Another Stabilizer

Elements prepared as described in Example 4 were used in this example except that the emulsions contained 5-nitro-4-methyl-4-thiazoline-2-thione (0.25 mmol/Ag mol) as the stabilizer, the matting agent was omitted from the protective overcoat layer, and the secondary binder was omitted from the emulsion layer. The imidazole compounds were added from a 1:4 acetone:methanol solution to the emulsion prior to coating.

As seen from the data in Table IV, Compound 13 suppressed fog and rereversal better than the alkyl-substituted compounds, and maintained good lower scale contrast, at a low concentration of only 2 mmol/Ag mol.

TABLE IV

| Antifoggant | mmol/Ag mol | Practical[1] speed | Dot-for-Dot[2] Dmin | Delta Dmin[3] | LSC[4] | Delta[5] Rereversal |
|---|---|---|---|---|---|---|
| None | 0 | 216 | 0.033 | — | 4.3 | — |
| 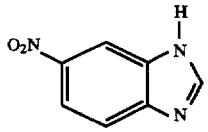 | 2 | 217 | 0.031 | −0.003 | 4.2 | −0.014 |
| | 4 | 213 | 0.030 | −0.004 | 4.3 | −0.01 |
| | 6 | 211 | 0.029 | −0.006 | 4.5 | −0.023 |
| 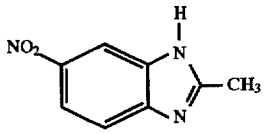 | 2 | 208 | 0.031 | −0.002 | 3.3 | −0.003 |
| | 4 | 199 | 0.034 | 0 | 2.3 | −0.006 |
| | 6 | 189 | 0.043 | +0.008 | 1.4 | +0.001 |
| 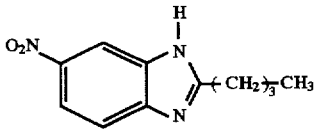 | 2 | 213 | 0.034 | 0 | 4.1 | +0.006 |
| | 4 | 211 | 0.035 | 0 | 4.3 | +0.005 |
| | 6 | 210 | 0.033 | −0.002 | 3.7 | +0.013 |
| 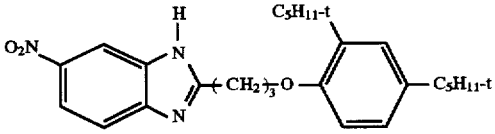 | 2 | 213 | 0.035 | 0 | 4.3 | −0.002 |
| | 4 | 214 | 0.033 | 0 | 4.1 | −0.002 |
| | 6 | 214 | 0.033 | 0 | 4.3 | +0.001 |
| Compound 13 | 2 | 205 | 0.031 | −0.003 | 4.3 | −0.021 |
| | 4 | 194 | 0.033 | −0.001 | 4.1 | −0.026 |
| | 6 | 194 | 0.031 | −0.002 | 4.3 | −0.023 |

[1]Speed measured at density faithfully reproducing halftone image
[2]Dmin at exposure faithfully reproducing halftone image
[3](Dmin antifoggant-Dmin control)
[4]Lower Scale Contrast measured by taking a slope between 0.10 and 0.60 net density
[5](D antifoggant - D control) measured at 2.5 log E higher exposure than dot-for-dot exposure, using 8 month old coatings

EXAMPLE 6

Preparation of Stabilized Element with Broad Dmin Window

Elements prepared as described in Example 4 were tested in this example, except that the emulsion was heated for 45 minutes at 70° C. prior to coating, and 5-nitro-4-methyl-4-thiazoline-2-thione (0.25 mmol/Ag mol) was added as the stabilizer and Compound 13 was added as the antifoggant. Control elements were similarly prepared and tested, which elements contained no stabilizer and/or no antifoggant, as indicated in Table V.

Table V below shows the results of using Compound 13 to suppress rereversal and provide stable coatings with a good Dmin window, comparable to the Dmin window of the unstabilized emulsions. The Control elements exhibited acceptable Dmin, but gained considerable speed during the one and two week accelerated keeping tests (incubated at 49° C./50% equilibrated relative humidity). The 5-nitro-4-methyl-4-thiazoline-2-thione stabilizer eliminated both speed gain and Dmin change. Compound 13 decreased the Dmin relative to the sample containing the stabilizer alone, and provided good stability.

TABLE V

| Stabilizer[7] mmol/Ag | Compound 13 | Speed[1] | Delta Speed[2] at 0.1 D | | Delta Speed[3] at 0.6 D | | Dmin | | | LSC[4] | | | Dot-for-Dot | Delta |
|---|---|---|---|---|---|---|---|---|---|---|---|---|---|---|
| mol | mmol/Ag mol | at 0.1 D | 1 wk | 2 wks | 1 wk | 2 wks | Fresh | 1 wk | 2 wks | Fresh | 1 wk | 2 wks | Dmin[5] | Rereversal[6] |
| 0 | 0 | 134 | 10 | 23 | 10 | 24 | 0.027 | 0.023 | 0.021 | 3.6 | 3.4 | 3.4 | 0.030 | — |
| 0.5 | 0 | 139 | 1 | 2 | 1 | 1 | 0.028 | 0.028 | 0.029 | 3.6 | 3.8 | 3.8 | 0.031 | +0.003 |
| 0.5 | 4.0 | 142 | 0 | 0 | 0 | 0 | 0.025 | 0.025 | 0.027 | 3.5 | 3.6 | 3.7 | 0.028 | −0.023 |
| KODAK RA ™ 2000 DEVELOPER AND REPLENISHER | | | | | | | | | | | | | | |
| 0 | 0 | 134 | 9 | 23 | 10 | 25 | 0.030 | 0.027 | 0.027 | 3.6 | 3.2 | 3.1 | | |

TABLE V-continued

| Stabilizer[7] mmol/Ag | Compound 13 | Speed[1] | Delta Speed[2] at 0.1 D | | Delta Speed[3] at 0.6 D | | Dmin | | | LSC[4] | | | Dot-for-Dot | Delta |
|---|---|---|---|---|---|---|---|---|---|---|---|---|---|---|
| mol | mmol/Ag mol | at 0.1 D | 1 wk | 2 wks | 1 wk | 2 wks | Fresh | 1 wk | 2 wks | Fresh | 1 wk | 2 wks | Dmin[5] | Rereversal[6] |
| 0.5 | 0 | 139 | −1 | 1 | −1 | 1 | 0.033 | 0.032 | 0.032 | 3.8 | 3.8 | 3.8 | | |
| 0.5 | 4.0 | 141 | 1 | 2 | 1 | 2 | 0.029 | 0.028 | 0.029 | 3.7 | 3.7 | 3.8 | | |
| KODAK ULTRATEC ™ DEVELOPER AND REPLENISHER | | | | | | | | | | | | | | |

[1]Speed measured at net specified density
[2,3](Speed incubated − Speed fresh) measured at net specified density
[4]Lower scale contrast measured by taking a slope between 0.10 and 0.60 net density
[5]Dmin at exposure faithfully reproducing halftone image
[6](D addenda − D control) measured at 2.5 log E higher exposure than dot-for-dot exposure using 2.6 year old coatings. Developed 30 sec in KODAK RA ™ 2000 Developer and Replenisher diluted 1:2 with water
[7]5-nitro-4-methyl-4-thiazoline-2-thione

EXAMPLE 7

Further Comparisons of Various Nitro-Substituted Imidazoles

Elements prepared as described in Example 4 were tested in this example using various nitro-substituted imidazoles in the emulsions which were stabilized with 5-nitro-4-methyl-4-thiazoline-2-thione. The imidazoles were added to the emulsions as aqueous dispersions (1.5%) which also contained gelatin (3%) and TRITON™ 200 surfactant (0.15%). Matting agent was omitted from the emulsion.

The results of the tests are shown in Table VI below. Compounds 6, 10, 44 and 49 were tested in elements of this invention and compared to Control elements containing imidazole compounds outside the scope of this invention. It is clear that a nitro substituent is needed on either side of the imidazole molecule, but not on both sides of it. The presence of an alkoxy substituent reduces the effectiveness of the imidazole. Compound 44 showed not only good antifoggant activity and rereversal suppression, but also exhibited excellent safelight-increasing characteristics.

TABLE VI

| Antifoggant | mmol/Ag mol | Practical[1] Speed | Dot-for-Dot[2] Dmin | Delta Dmin[3] | Delta[4] Rereversal | Safelight (min) White[5] | Yellow[6] |
|---|---|---|---|---|---|---|---|
| None | 0 | 235 | 0.045 | — | — | 18 | 70 |
| 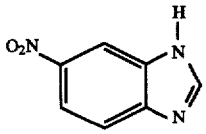 | 2 | 233 | 0.039 | −0.004 | −0.006 | 18 | 55 |
| | 6 | 230 | 0.032 | −0.010 | −0.021 | 12 | 43 |
| Compound 10 | 2 | 227 | 0.036 | −0.005 | −0.012 | 16 | 48 |
| Compound 6 | 2 | 226 | 0.035 | −0.007 | −0.026 | 12 | 40 |
| 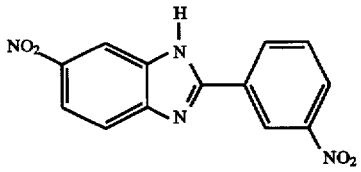 | 2 | 225 | 0.049 | +0.005 | +0.005 | 16 | 52 |
| Compound 44 | 2 | 214 | 0.034 | −0.007 | −0.031 | 23 | 100 |
| 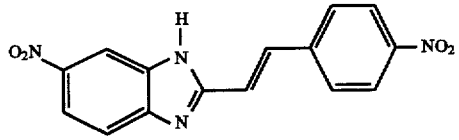 | 2 | 220 | 0.049 | +0.003 | −0.011 | 22 | 70 |
| Compound 49 | 2 | 229 | 0.039 | −0.004 | −0.006 | 19 | 60 |

TABLE VI-continued

| Antifoggant | mmol/Ag mol | Practical[1] Speed | Dot-for-Dot[2] Dmin | Delta Dmin[3] | Delta[4] Rereversal | Safelight (min) White[5] | Yellow[6] |
|---|---|---|---|---|---|---|---|
| 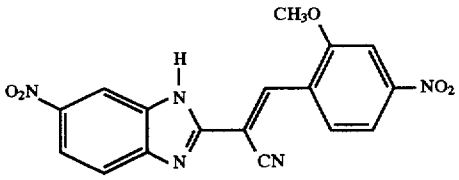 | 2 | 227 | 0.048 | +0.002 | +0.009 | 18 | 60 |

[1]Speed measured at density faithfully reproducing halftone image
[2]Dmin at exposure faithfully reproducing haftone image
[3](Dmin antifoggant - Dmin control)
[4](D antifoggant - D control) measured at 2.5 log E higher exposure than dot-for-dot exposure
[5]Shortest time of safelight exposure (40 Watt Deluxe Cool White fluorescent lamp with UV filter sleeves at 40 foot-candle) prior to sensitometric exposure and development causing a 2% change in a 50% dot
[6]Shortest time of safelight exposure (40 Watt F40 Gold Lamp at 40 foot-candle) prior to sensitometric exposure and development causing a 2% change in a 50% dot

EXAMPLE 8

Evaluation of AgCl Elements

The emulsion of Example 2 was coated to form a photographic element of this invention as described in Example 4 except that filter dyes and stabilizer were omitted. Various imidazoles were included in the emulsions as noted in Table VII below. Low concentrations of benzimidazoles decreased both Dmin and rereversal of the silver chloride emulsions. Compound 10 was especially useful.

The results are shown in Table VIII below. The contrast of the KODAK Camera 2000 Film CGP developed in developer that had been seasoned with a control film containing no antifoggant remained relatively unchanged with progressive seasoning (A). However, the contrast of the same film developed with the same developer seasoned with an element containing the comparison compound 5-nitrobenzimidazole (10 mmol/Ag mol) decreased at replenishment rates higher than 0.2 tank turnovers ("TT", replenishment rate of 232.6 ml/m$^2$) (B). Contrast loss signified inhibition of nucleating development. The contrast of

TABLE VII

| Antifoggant | mmol/Ag mol | Speed at 0.1 D[1] | Dot-for-Dot[2] Dmin | Delta Dmin[3] | LSC[4] | Delta[5] Rereversal |
|---|---|---|---|---|---|---|
| None | 0 | 232 | 0.039 | — | 3.6 | — |
| 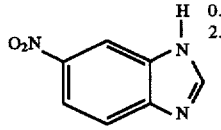 | 0.50 | 231 | 0.034 | −0.004 | 3.5 | −0.003 |
| | 2.0 | 236 | 0.028 | −0.009 | 3.7 | −0.003 |
| Compound 10 | 0.50 | 228 | 0.03 | −0.004 | 3.7 | −0.004 |
| | 2.0 | 225 | 0.023 | −0.008 | 3.9 | −0.003 |
| Compound 13 | 0.50 | 225 | 0.027 | −0.007 | 3.9 | — |

[1]Speed measured at net specified density
[2]Dmin at exposure faithfully reproducing halftone image
[3](Dmin antifoggant - Dmin control)
[4]Lower Scale Contrast measured by taking a slope between 0.10 and 0.60 net density
[5](D antifoggant - D control) measured at 2.5 log E higher exposure than dot-for-dot exposure

EXAMPLE 9

Evaluation of Nucleating Development Compatability

An element containing a silver bromide emulsion and Compound 13 (2 mmol/Ag mol) was prepared as described in Example 4 above except that it contained neither a stabilizer nor a matting agent in the overcoat layer.

Nucleating development (38 sec at 35° C.) of nucleator-containing KODAK Camera 2000 Film CGP was studied in KODAK RA Developer and Replenisher. The developer was seasoned with increasing amounts of the test films described above or comparison films, and was monitored as a function of seasoning.

the same film developed with the same developer seasoned with the element of this invention containing Compound 13 was relatively stable during seasoning and was comparable to the contrast produced by developer seasoned with the film containing no antifoggant (C).

This example demonstrates the nucleating development compatability of Compound 13, which was shown in previous examples to decrease the Dmin and to broaden the Dmin window as effectively as the comparison compound, 5-nitrobenzimidazole, but at lower concentrations.

TABLE VIII

| Developer Seasoning* | Dmin | Speed at[1] 0.10 CR | 3.0 CR | EC[2] | LSC[3] | MSC1[4] | USC3[5] |
|---|---|---|---|---|---|---|---|
| A. Seasoning film without antifoggant | | | | | | | |
| FR 38" | 0.022 | 239 | 224 | 18.9 | 14.7 | 17.3 | 15.3 |
| 0.2TT 38" | 0.022 | 240 | 225 | 20.2 | 14.1 | 19.5 | 18.5 |
| 0.3TT 38" | 0.022 | 240 | 225 | 18.7 | 12.8 | 19.4 | 20.8 |
| 0.5TT 38" | 0.024 | 240 | 223 | 17.8 | 13.1 | 16.5 | 14.9 |
| 0.7TT 38" | 0.024 | 240 | 225 | 19 | 12 | 19.8 | 21.2 |
| 1.0TT 38" | 0.025 | 244 | 227 | 16.4 | 7.8 | 16.5 | 16.6 |
| 1.5TT 38" | 0.025 | 239 | 219 | 14.2 | 7.3 | 14.8 | 15.9 |
| B. Seasoning film contained 10 mmol/Ag mol of 5-nitrobenzimidazole | | | | | | | |
| FR 38" | 0.022 | 239 | 224 | 19.7 | 15.1 | 17.7 | 15.2 |
| 0.2TT 38" | 0.021 | 240 | 217 | 12.4 | 6.1 | 12.1 | 11.7 |
| 0.3TT 38" | 0.02 | 238 | 212 | 11.1 | 5 | 9.4 | 7.6 |
| 0.5TT 38" | 0.021 | 239 | 202 | 8.3 | 4.4 | 6.7 | 5.1 |
| 0.7TT 38" | 0.021 | 233 | 191 | 7.2 | 3.9 | 6.2 | 5.1 |
| 1.0TT 38" | 0.021 | 238 | 192 | 6.4 | 3.7 | 6.1 | 5.6 |
| 1.5TT 38" | 0.02 | 238 | 187 | 5.5 | 3.1 | 5.8 | 6.4 |
| C. Seasoning film contained 2 mmol/Ag mol of Compound 13 | | | | | | | |
| FR 38" | 0.022 | 239 | 224 | 18.7 | 14.2 | 18.1 | 17.3 |
| 0.2TT 38" | 0.022 | 239 | 222 | 16.2 | 12.5 | 15.9 | 15.4 |
| 0.3TT 38" | 0.023 | 239 | 224 | 17.8 | 12.2 | 18.5 | 19.7 |
| 0.5TT 38" | 0.023 | 240 | 221 | 15.2 | 10.9 | 14.8 | 14.1 |
| 0.7TT 38" | 0.025 | 240 | 219 | 14.3 | 10.7 | 13.7 | 13 |
| 1.0TT 38" | 0.022 | 240 | 220 | 14.2 | 10.1 | 14.3 | 14.3 |
| 1.5TT 38" | 0.024 | 240 | 218 | 13.6 | 9.3 | 12.1 | 10.3 |

*Seasoning rate of 232.6 ml of developer replenisher added per square meter of seasoning film was used to achieve the specified tank turnover
[1]Speed measured at net specified density
[2]Contrast measured by taking a slope between 0.1 and 2.50 net density
[3]Lower scale contrast measured by taking a slope between 0.1 and 0.60 net density
[4]Midscale contrast measured by taking a slope between 0.1 and 4.0 net density
[5]Upper scale contrast measured by taking a slope between 2.5 and 4.0 net density The invention has been described in detail with particular reference to preferred embodiments thereof, but it will be understood that variations and modifications can be effected within the spirit and scope of the invention.

We claim:

1. A room-light handleable, direct-positive silver halide emulsion that requires at least about 10,000 ergs/cm$^2$ to provide minimum density, said emulsion comprising, as a rereversal suppressant, a nitro-substituted aryl- or heteroaryl- containing imidazole that is present in an amount of at least about 0.01 mmol/mol of silver, said nitro-substituted aryl- or heteroaryl-containing imidazole having the structure:

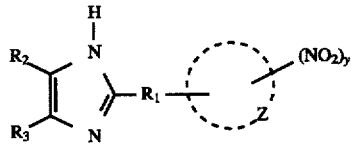

wherein $R_1$ is a single carbon-carbon bond or substituted or unsubstituted —CH=CH—, $R_2$ and $R_3$ are independently hydrogen, aryl, nitro-substituted aryl, nitro or cyano, or $R_2$ and $R_3$ together represent the carbon atoms necessary to complete a 6- to 10-membered aromatic carbocyclic ring fused with the imidazole ring, said aromatic carbocyclic ring being substituted or unsubstituted with one or two nitro groups, Z represents the carbon and oxygen atoms necessary to complete a phenyl or furanyl ring, and y is 0, 1 or 2, provided that when y is 0 and $R_1$ is substituted —CH=CH—, then $R_1$ is free of nitro groups and $R_2$ or $R_3$ or $R_2$ and $R_3$ together contain 1 or 2 nitro groups, and when y is 1 or 2, then $R_2$ or $R_3$, or $R_2$ and $R_3$ together are free of nitro groups, and further provided that said structure is free of alkyl and alkoxy groups.

2. The silver halide emulsion of claim 1 wherein $R_2$ and $R_3$ together represent the carbon atoms necessary to complete a phenyl ring with the imidazole ring, said phenyl ring having 1 to 2 nitro substituents, and y is 0.

3. The silver halide emulsion of claim 2 wherein Z represents a phenyl ring, and $R_1$ is substituted or unsubstituted —CH=CH—.

4. The silver halide emulsion of claim 2 wherein said phenyl ring has one nitro substituent.

5. The silver halide emulsion of claim 1 wherein said nitro-substituted aryl- or heteroaryl-containing imidazole is

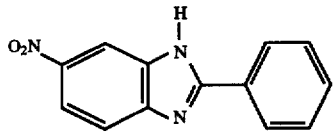

Compound 6

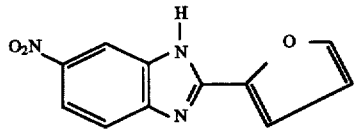

Compound 13 or

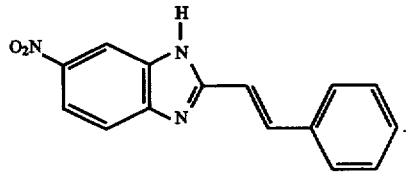

Compound 44

6. The silver halide emulsion of claim 1 wherein said nitro-substituted aryl- or heteroaryl-containing imidazole is present in an amount of from about 0.01 to about 50 mmol/mol of silver.

7. The silver halide emulsion of claim 6 wherein said nitro-substituted aryl- or heteroaryl-containing imidazole is present in an amount of from about 0.1 to about 10 mmol/mol of silver.

8. The silver halide emulsion of claim 1 comprising at least 50 mol % silver bromide and up to about 50 mol % silver chloride, based on total silver.

9. The silver halide emulsion of claim 8 comprising at least 90 mol % silver bromide based on total silver, and no silver iodide.

10. The silver halide emulsion of claim 9 at least 90 mol % silver chloride, based on total silver and no silver iodide.

11. The silver halide emulsion of claim 1 further comprising a stabilizer.

12. The silver halide emulsion of claim 1 further comprising a polyhaloiridium dopant.

13. The silver halide emulsion of claim 12 wherein said polyhaloiridium dopant is a polybromo coordination complex of iridium with two or more bromo ligands and the remaining ligands are aquo, chloro, fluoro, iodo or nitrosyl ligands.

14. A photographic element comprising a support having thereon at least one photosensitive layer comprising the silver halide emulsion of claim 1.

15. The photographic element of claim 14 further comprising an overcoat layer disposed on said photosensitive layer.

16. The photographic element of claim 15 further comprising an interlayer between said photosensitive layer and said overcoat layer.

17. The photographic element of claim 16 wherein said interlayer comprises one or more filter dyes.

18. A photographic element comprising a transparent film support, and having thereon a single photosensitive layer comprising a room-light handleable, direct-positive silver halide emulsion that requires at least about 10,000 ergs/cm$^2$ to provide minimum density, said emulsion comprising from 50 to 100 mol % silver bromide and no silver iodide, based on total silver, a polyhaloiridium dopant, and as a rereversal suppressant, a nitro-substituted aryl- or heteroaryl-containing imidazole that is present in an amount of from about 0.1 to about 10 mmol/mol of silver, said nitro-substituted aryl- or heteroaryl-containing imidazole having the structure:

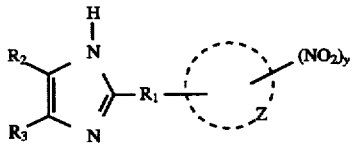

wherein $R_1$ is a single carbon-carbon bond or substituted or unsubstituted —CH=CH—, $R_2$ and $R_3$ are independently hydrogen, aryl, nitro-substituted aryl, nitro or cyano, or $R_2$ and $R_3$ together represent the carbon atoms necessary to complete a 6- to 10-membered aromatic carbocyclic ring fused with the imidazole ring, said aromatic carbocyclic ring being substituted or unsubstituted with one or two nitro groups, Z represents the carbon and oxygen atoms necessary to complete a phenyl or furanyl ring, and y is b 0, 1or 2, provided that when y is 0 and $R_1$ is substituted —CH=CH—, then $R_1$ is free of nitro groups and $R_2$ or $R_3$, or $R_2$ and $R_3$ together contain 1 or 2 nitro groups, and when y is 1 or 2, then $R_2$or $R_3$, or $R_2$ and $R_3$ together, are free of nitro groups, and further provided that said structure is free of alkyl and alkoxy groups.

19. The element of claim 18 further comprising an overcoat layer containing a matting agent, and an interlayer between said emulsion layer and said overcoat layer, said interlayer containing one or more solid filter dyes.

20. The element of claim 18 wherein said nitro-substituted aryl- or heteroaryl-containing imidazole is

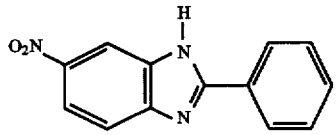

Compound 6

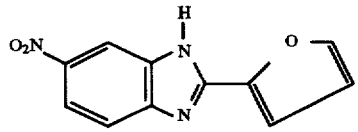

Compound 13 or

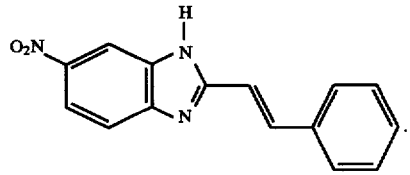

Compound 44

* * * * *